United States Patent [19]

Donnelly

[11] Patent Number: 4,500,169

[45] Date of Patent: Feb. 19, 1985

[54] COSMETIC AND OBSERVER LINE OF SIGHT MIRROR

[76] Inventor: John H. Donnelly, 234 Eagle Rock Ave., West Orange, N.J. 07052

[21] Appl. No.: 397,819

[22] Filed: Jul. 13, 1982

[51] Int. Cl.[3] ..... G02B 5/08; G01C 3/00

[52] U.S. Cl. ..... 350/288; 248/476; 356/21; 434/91

[58] Field of Search ..... 350/308, 304, 288; 356/139, 21; 248/476–478; 434/91, 94, 97, 371

[56] References Cited

U.S. PATENT DOCUMENTS

| | | | |
|---|---|---|---|
| 669,705 | 3/1902 | Reeh | 356/139 |
| 993,051 | 5/1911 | Germain | 248/477 |
| 1,832,248 | 11/1931 | Schrader | 350/288 |
| 2,619,002 | 11/1952 | Baker | 356/139 |
| 3,876,293 | 4/1975 | Ramos | 350/288 |

FOREIGN PATENT DOCUMENTS

| | | | |
|---|---|---|---|
| 1410811 | 3/1922 | United Kingdom | 350/308 |

*Primary Examiner*—John K. Corbin
*Assistant Examiner*—David Lewis
*Attorney, Agent, or Firm*—Eugene E. Geoffrey, Jr.

[57] ABSTRACT

A cosmetic and observer line of sight mirror which includes a mirror having two sets of orthogonal lines with one set substantially horizontal and disposed over the face of the mirror or about the edge thereof to facilitate application of cosmetics to produce a balanced effect and enable movement of the mirror through selected angles about a horizontal axis to afford the user an image corresponding to the user's appearance observed by another at a selected distance and elevation. The mirror may also be provided with supporting means for leveling the mirror and include a scale calibrated in terms of elevation and distance of an observer.

7 Claims, 13 Drawing Figures

FIG. 11B.

12" FOCAL LENGTH DISTANCE (36")

| 3" | | 2" | | 1" | | 0 | | -1" | | -2" | | -3" |
|---|---|---|---|---|---|---|---|---|---|---|---|---|
| 9 | 8 | 7 | 6 | 5 | 4 | 3 | 2 | 1 | 1 | 2 | 3 | 4 | 5 | 6 | 7 | 8 | 9 |

HEIGHT GREATER THAN USER'S (INCHES) | HEIGHT LESS THAN USER'S (INCHES)

SCALE GRADUATIONS (INCHES)

FIG. 11A.

9" FOCAL LENGTH DISTANCE (36")

| 3" | | 2" | | 1" | | 0 | | -1" | | -2" | | -3" |
|---|---|---|---|---|---|---|---|---|---|---|---|---|
| 12 | 11 | 10 | 9 | 8 | 7 | 6 | 5 | 4 | 3 | 2 | 1 | 1 | 2 | 3 | 4 | 5 | 6 | 7 | 8 | 9 | 10 | 11 | 12 |

HEIGHT GREATER THAN USER'S (INCHES) | HEIGHT LESS THAN USER'S (INCHES)

SCALE GRADUATIONS (INCHES)

FIG. 10B.

12" FOCAL LENGTH DISTANCE

| | 1" | | 2" | | 3" | | 4" |
|---|---|---|---|---|---|---|---|
| 36" | 1 | 2 | 3 | 4 | 5 | 6 | 7 | 8 | 9 | 10 | 11 | 12 |
| 72" | 2 | 4 | 6 | 8 | 10 | 12 | 14 | 16 | 18 | 20 | 22 | 24 |
| 96" | 3 | 6 | 9 | 12 | 15 | 18 | 21 | 24 | 27 | 30 | 33 | 36 |

HEIGHT GREATER OR LESS THAN USER'S HEIGHT (INCHES)

SCALE GRADUATIONS (INCHES)

FIG. 10A.

9" FOCAL LENGTH DISTANCE

| | 1/4 | 1/2 | 3/4 | 1" | | 2" | | 3" | | 4" |
|---|---|---|---|---|---|---|---|---|---|---|
| 36" | 1 | 2 | 3 | 4 | 5 | 6 | 7 | 8 | 9 | 10 | 11 | 12 | 13 | 14 | 15 | 16 |
| 72" | 2 | 4 | 6 | 8 | 10 | 12 | 14 | 16 | 18 | 20 | 22 | 24 | | | | |
| 96" | 3 | 6 | 9 | 12 | 15 | 18 | 21 | 24 | 27 | 30 | 33 | 36 | | | | |

HEIGHT GREATER OR LESS THAN USER'S HEIGHT (INCHES)

SCALE GRADUATIONS (INCHES)

COSMETIC AND OBSERVER LINE OF SIGHT MIRROR

This invention relates to an improved cosmetic and observer line of sight mirror and more specifically to a novel and improved mirror which not only facilitates application of cosmetics or make-up to achieve a desired objective but also enables assessment of one's appearance when viewed by persons at greater or lesser elevations and at varying distances.

Known mirrors for use in the application of cosmetics such as eye liner, eye shadow, eyebrow coloring, rouge, lipstick and the like are generally in the form of either plane or concave structures of a variety of sizes, shapes and mountings. Such mirrors merely provide a simple image of the user and do not enable the user to either carefully balance the applied make-up or afford the user information pertaining to appearance as observed by others at varying distances and elevations.

This invention overcomes the difficulties and shortcomings of prior known mirrors and provides a novel and improved mirror which embodies means for affording the user information relating to the application of cosmetics and the appearance thereof to others and which is characterized by its simplicity, ease of operation and relatively low cost.

Still another object of the invention resides in the provision of a mirror embodying means for providing the user with information pertaining to the appearance presented to persons at a variety of distances and elevations.

A still further object of the invention resides in the provision of a novel and improved cosmetic and observer line of sight mirror.

The mirror in accordance with the invention may be formed of silvered glass, reflective metal or the like of any desired size and shape and is provided with uniformly spaced vertical and horizontal lines or graduations which in one aspect of the invention permits the user to carefully apply make-up to achieve a proper balanced configuration. The invention further provides means for mechanically tilting the mirror through selected angles to simulate precisely the line of sight of another viewing the user at selected distances and elevations and thereby present the user with the combined effect of the hair styling in combination with the make-up at such distances and elevations.

The above and other objects and advantages will become more apparent from the following description and accompanying drawings forming part of this application.

IN THE DRAWINGS

FIG. 9 is a diagrammatic illustration of certain objectives which may be attained by a mirror in accordance with the invention; and FIGS. 10A, 10B, 11A and 11B are forms of scales or charts to simplify angular adjustment of the mirror.

The mirror in accordance with the invention is constructed and arranged to facilitate the application of cosmetics or make-up by enabling the user to apply the make-up uniformly to both sides of the face and at the same time compensate at least in part for differences in facial configurations of each side of the face. It also enables the user to treat natural features to achieve the best advantage.

In addition to the application of cosmetics or make-up, the mirror also enables the user to observe the total effect achieved as would be observed by one at a selected distance and elevation. By appropriately tilting the mirror through a predetermined angle based on the distance of the viewer from the mirror, the viewer will observe an image corresponding to that observed by another individual who for instance may be somewhat taller than the viewer and positioned at a selected distance from the viewer. In this way, the viewer can very easily adjust the application of cosmetics or make-up as well as the arrangement of the hair to produce the most desirable effect.

Figure 1:
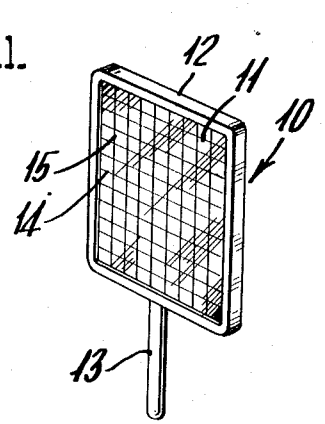
FIG. 1 is a perspective view of a hand-held cosmetic or vanity mirror in accordance with the invention.

Referring now to the drawings and more specifically to FIG. 1, a hand-held cosmetic mirror is generally denoted by the numeral 10 and is provided with a mirror 11 having a frame 12 and a handle 13. In this embodiment of the invention, the mirror is provided with a set of horizontal lines 14 and a set of vertical lines 15. The sets of lines 14 and 15 may have any desired spacing and while shown as covering the entire surface of the mirror, may be restricted to only a portion of the mirror as may be desired. All of the horizontal lines are preferably uniformly spaced and all of the vertical lines are also uniformly spaced. With this arrangement, the user, when applying cosmetics or make-up, is able to treat both portions of the face uniformly and at the same time compensate for natural differences in the features on each side of the face. As will be discussed in detail, the user can by tilting the mirror about a horizontal axis while maintaining the vertical position of the mirror substantially constant view an image that would be seen by an oberver at a selected distance and elevation relative to the user's height. The angular shift can be determined by the shift in the horizontal lines 15 as observed by the user and by coordinating the spacing between the horizontal lines with the normal distance of the mirror from the user. In this way, as will be discussed in detail, the user can determine the appearance presented to an individual who is for instance five inches taller than the user and at a distance for example of three feet from the user. This form of the invention merely provides the user with approximate information and more specific information can be obtained by modifications of the invention as shown for instance in FIGS. 2, 3, 5 and 8.

It is evident from the foregoing description and will be evident from the description of the following embodiments of the invention that the user will maintain a line of sight with the image. Then, as the mirror is tilted about a horizontal axis, the position of the image of the user will shift vertically, the line of sight will tilt upwardly or downwardly depending upon the direction of tilt about the horizontal axis. Therefore, by spacing the horizontal lines on the mirror at precise distances depending upon the distance of the viewer from the mirror, the viewer can observe the appearance presented to an observer at a predetermined distance from the viewer and at a different elevation. This effect will become clear from the discussion of FIGS. 10–11. For the convenience of the user, however, scales may be provided for adjusting the tilt of the mirror to avoid the need for selected spacing of the horizontal lines.

Figure 2:
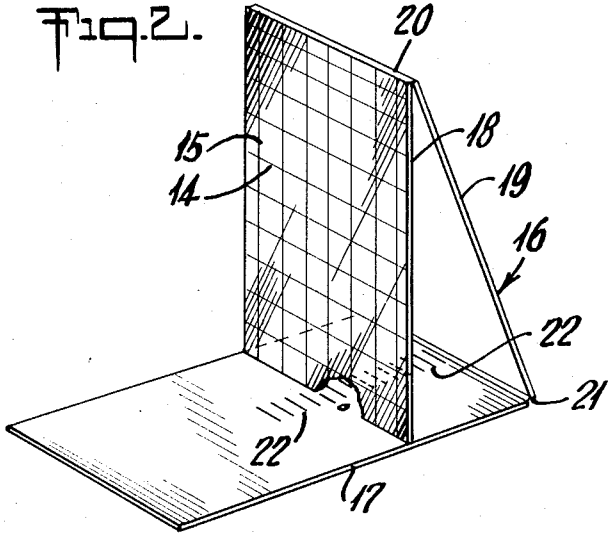
FIG. 2 is a perspective view of a vanity or cosmetic mirror in accordance with the invention and embodying means for angularly adjusting the mirror relative to the line of sight of the viewer.

Referring now to FIG. 2 which illustrates an adjustable mirror adapted to be placed on a vanity and, as will be described, is adjustable for achieving the objectives of the invention. More specifically, the mirror generally denoted by the numeral 16 comprises a base 17, a mirror 18, illustrated in the drawing in a vertical position, and a rear support 19 hinged at the top 20 to the mirror 18 and at the bottom 21 to the rear edge of the base 17. The base 17 includes a series of notches 22 to engage the bottom edge of the mirror 18 to hold it in selected positions. The mirror 16, in the illustrated embodiment, has a plurality of horizontal lines 14 and a plurality of vertical lines 15 which serve the same purpose as the horizontal and vertical lines illustrated in FIG. 1.

The horizontal and vertical lines 14 and 15 of both FIGS. 1 and 2 may either be formed directly on the glass mirror by etching or other suitable means or may be in the form of a transparent overlay carrying the two sets of parallel lines. If desired, the horizontal and vertical parallel lines may cover the entire surface of the mirror as illustrated or in the alternative may cover only a portion of the mirror such as the edge portion or may even be carried about the edge of the mirror.

In FIG. 2, an appropriate scale may be imprinted upon the base 17 to facilitate positioning of the mirror to achieve the desired effect for the viewer and permit the viewer to observe his or her appearance as viewed by another at a specific distance and elevation. Forms of scales are illustrated in FIGS. 10A and B and 11A and B and will be discussed later in detail since the scales would apply not only to the structure of FIG. 2 but modified structures now to be described.

Figure 3:
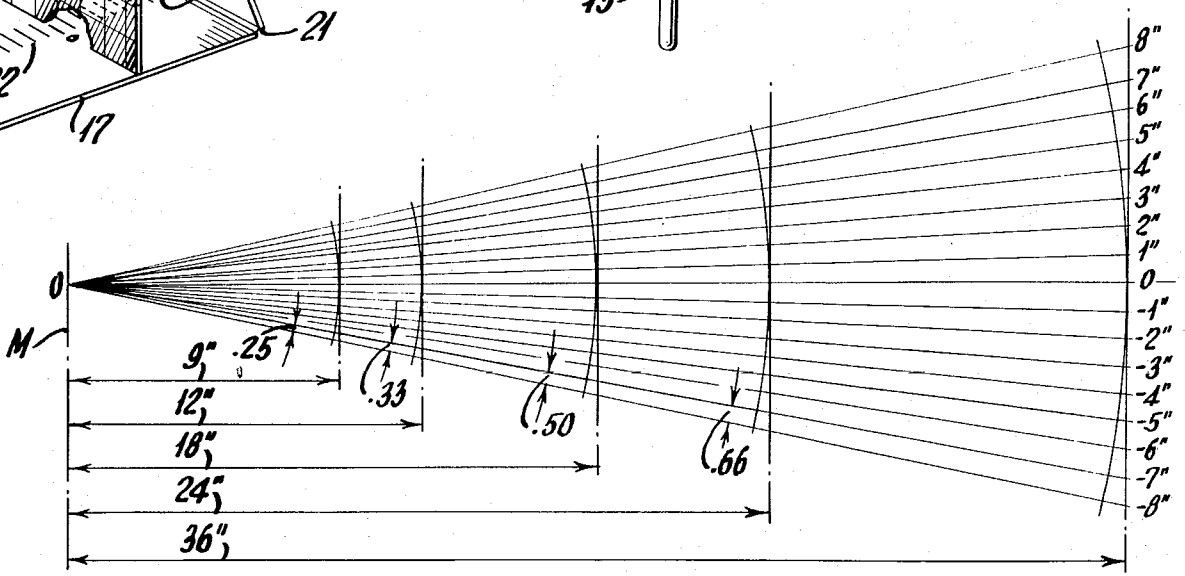
FIG. 3 is a perspective view of a modified cosmetic or vanity mirror in accordance with the invention and embodying means for angularly adjusting the mirror relative to the line of sight of the viewer.
Figure 3:
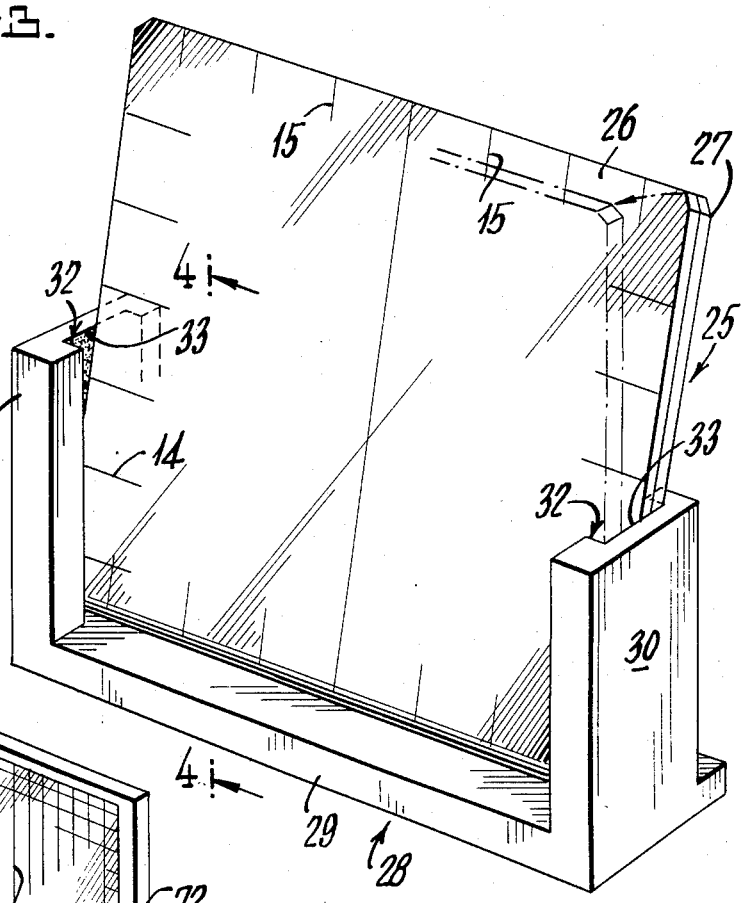
Figure 4:
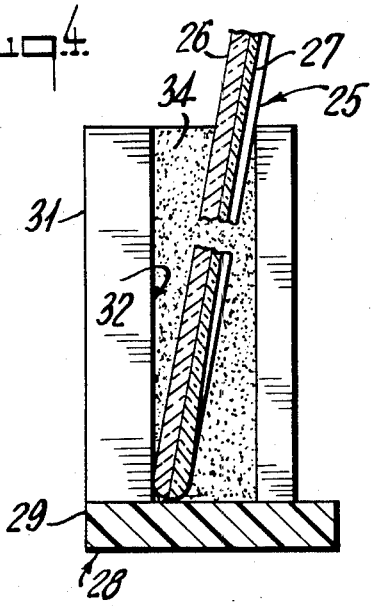
FIG. 4 is a cross-sectional view of FIG. 3 taken along the line 4—4 thereof.

FIGS. 3 and 4 illustrate a modified form of the invention which includes a substantially rectangular mirror generally denoted by the numeral 25 which has a plain surface 26 on one side thereof and a concave surface 27 on the other side thereof. The mirror 25 is supported by a stand 28 having a base 29 and a pair of uprights 30 and 31 each having a relatively wide vertical channel 32 disposed between the edges thereof. The inner or bottom surface 33 of each channel carries a thin layer of resilient material such as felt or the like and denoted by the numeral 34 as illustrated more clearly in FIG. 4.

With the foregoing arrangement, the mirror 25 can either be positioned vertically, can be tilted to the right as illustrated in FIGS. 3 and 4 or can be tilted to the left. In each instance, the felt will function to maintain the mirror in the selected position. In this embodiment of the invention, the horizontal lines 14 and vertical lines 15 are shown extending inwardly a short distance from the edges of the mirror. If desired, however, the horizontal and vertical lines may of course cover the entire surface of the mirror as illustrated in FIGS. 1 and 2. This form of the invention also provides for a plain mirror as well as a magnifying mirror through the lines 14 and 15 would preferably be utilized only in connection with the plain mirror. The top surface of each of the uprights 30 and 31 may include a scale for angularly positioning the mirror so that the user can observe an image corresponding to the appearance presented to another at a selected distance and elevation.

Figure 5:
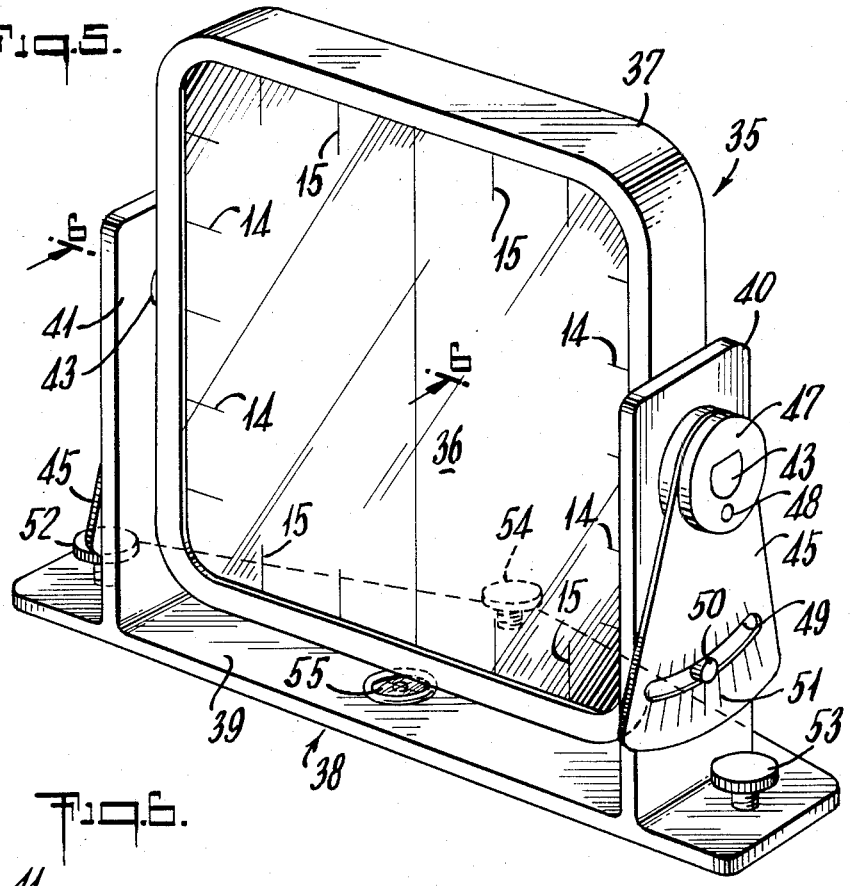
FIG. 5 is a perspective view of still another embodiment of a cosmetic or vanity mirror in accordance with the invention and embodying leveling means for the mirror, a level indicator and an angular scale for precisely setting the angular position of the mirror relative to the line of sight of the viewer.
Figure 6:
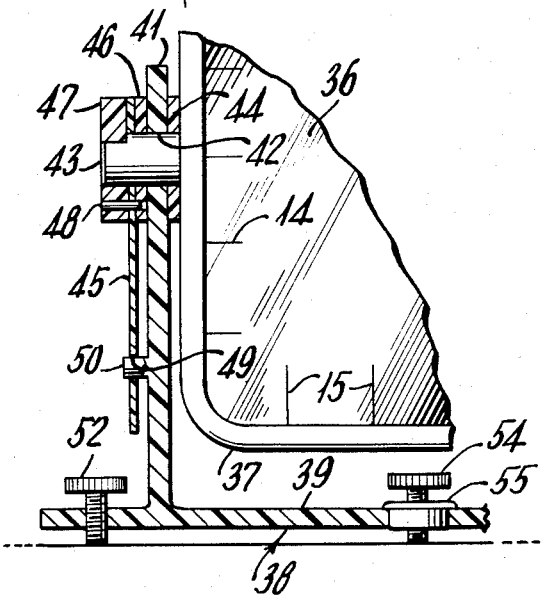
FIG. 6 is a cross sectional view of FIG. 5 taken along the line 6—6 thereof.
Figure 7:
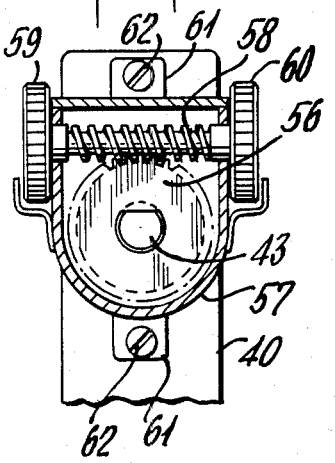
FIG. 7 is an elevational view in partial section of means which may be utilized in the structure of FIG. 5 for adjusting the angular position of the mirror.

A further modification of the invention is illustrated in FIGS. 5 through 7. In this embodiment, the mirror is generally denoted by the numeral 35 and includes a plain mirror 36 carried by a surrounding frame 37. The mirror supporting structure generally denoted by the numeral 38 includes a base 39 and a pair of upright members 40 and 41 affixed to the base. Each of the upright members has an opening 42 therein, as illustrated in FIG. 6 in connection with the upright member 41, and trunions 43 carried by the mirror frame 37 extend through the openings 42 in the uprights 40 and 41. The mirror 35 is centered between the uprights 40 and 41 by spacer washers 44 as illustrated in FIG. 6 and a triangular member 45 depends from each of the trunions 43 and is held between spacing washers 46 and 47 which are keyed by a pin 48. The spacer washers 46 and 47 and the triangular member 45 carried by each of the trunions 43 are suitably fixed to the trunions so that the triangular members will be displaced as the mirror is moved about the trunions. Each of the triangular members 45 includes an elongated arcuate slot 49 and an associated graduated scale 51 as shown more clearly in FIG. 5. A pin 50 is fixed to each of the uprights 40 and 41 and extends through the associated slot 49. Each pin cooperates with the graduated scale 51 adjoining each slot to indicate the precise angle of the mirror for purposes as will be discussed in connection with FIGS. 9, 10 and 11.

In many instances, it is desirable to level the mirror in order to achieve the best results and accordingly, the base 38 is provided with three leveling screws 52, 53 and 54 together with a spherical level 55. It is understood of course that other suitable leveling means may be utilized and any suitable type of level may also be employed.

In the embodiment of the invention shown in FIGS. 5 and 6, the mirror 35 can be angularly displaced merely by moving the scales 45 or by moving the mirror itself. If desired, a suitable arrangement such as illustrated in FIG. 7 may be employed in which case the triangular members 45 and indexing pins 50 can be replaced by application of the scale directly to a surface of one of the control knobs. More specifically, one of the trunions 43 would carry a spur gear 56 fixed to the trunion so that rotation of the gear will also rotate the mirror. The spur gear 56 is enclosed within a housing 57 and a worm gear 58 is rotatably carried by the housing 57 and meshes with the spur gear 56. In the instant embodiment of the invention, knobs 59 and 60 are carried on each of the ends of the worm gear shaft so that rotation of the knobs will automatically rotate the mirror 35 about the trunions 43. A suitable scale may be carried on the face of one or both of the knobs in order to precisely set the desired mirror angle. The housing 57 has a pair of tabs 61 extending therefrom to accommodate screws 62 to secure the housing to the uprights 40 or 41 as the case may be.

As in the case of the previous embodiments of the invention, the embodiment shown in FIG. 5 includes horizontal and vertical lines 14 and 15 which may be disposed about the edge of the mirror or in the alternative may extend over the entire surface of the mirror as desired. The mirror 35 in addition to having a plain mirror on one surface thereof may also include a magnifying mirror on the reverse side thereof.

Figure 8:
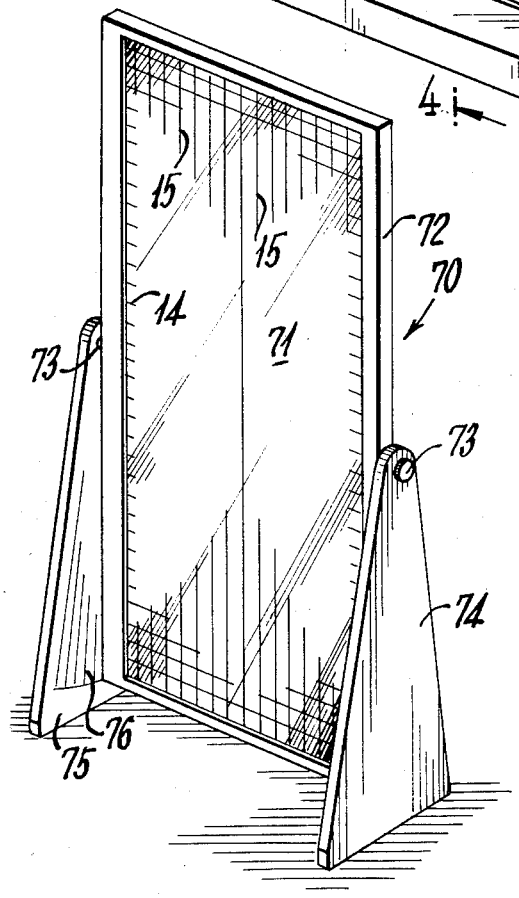
FIG. 8 is a perspective view of a floor length or vanity mirror in accordance with the invention.

Still another modification of the invention is illustrated in FIG. 8 which may be in the form of a floor length mirror or by reducing the scale made in the form of a vanity mirror. In this form of the invention, the mirror 71 is supported by a surrounding frame 72 having a pair of trunions 73 spaced generally midway of the height of the mirror 71. A pair of triangularly shaped supports 74 and 75 each have an opening adjoining the apex which rotatably engages a trunion 73 so that the miror can be tilted either in one direction or the other. Any suitable means may be provided to maintain the mirror 71 in a selected angular position such as friction washers disposed between the supports 74 and 75 and the mirror frame 72 and engaging the trunions in order to maintain the mirror in a selected angular position. Any other suitable means may also be employed. A scale 76 is provided on the side of the support 75 and a similar scale may also be provided on the inner side of the support 74. The scale 76, as discussed in connection with previous embodiments of the invention, has graduations which are suitably identified, as will be discussed in connection with FIGS. 9, 10 and 11, to facilitate precise adjustment by the user in order to achieve the user's objective. As in the case of the previous embodiments of the invention, the mirror may be provided with horizontal and vertical lines 14 and 15 respectively disposed either about the edges of the mirror or over the entire mirror surface as may be desired.

Referring now to FIG. 9 which illustrates certain functions of the mirrors previously described in order to provide the user with an image corresponding to the appearance of the user as observed by another at a predetermined distance and elevation. More specifically, if a mirror having the grid heretofore described with horizontal and vertical lines is positioned so that it is coincident with the line M and in a vertical plane, the user if positioned for instance 9 inches from the mirror will observe an image corresponding to the appearance presented by the user to another at any distance and at the elevation of the user. In the instant illustration, the rays eminating from the point 0 are spaced so that they are a quarter inch apart at a distance of 9 inches and if the horizontal lines on the mirror are spaced a quarter inch apart, and the user's eye is aligned with one specific horizontal line, then if the mirror is tilted to bring the next line above the first line into alignment with the user's sight, then the user will observe an image corresponding to the appearance presented to another who is an inch taller than the user and at a distance of 36 inches. Similarly, if the mirror is tilted to bring the eighth line above the zero line into alignment with the user's view, then the user will observe an image corresponding to the appearance that would be presented to another who is eight inches taller than the user and is positioned at a distance of 36 inches. Similarly, the same image presented to the user would be that observed by an individual at a distance of eighteen inches but only four inches taller than the user. The same principal applies to the adjustment of the mirror to determine the image presented to another observer should the observer be shorter in stature than the user.

Similarly, the user can observe an image in the mirror at a distance of 12 inches, 18 inches or even 24 inches. For instance, if the user is at 18 inches, the mirror would have to be tilted to bring the second line above horizontal into alignment with the user's eyes in which case the image observed by the user would be that presented to another two inches taller than the user and at a distance of 36 inches.

FIGS. 10A and 10B and FIGS. 11A and 11B show modifications of scale graduations that may be used in connection with the embodiments of the invention previously described. In FIG. 10A, a scale graduation for a situation wherein the user is 9 inches from the mirror is illustrated and is based on the smallest graduation being one quarter of an inch. The major graduations are therefore one inch, two inches, three inches and four inches and the major graduations could be indicated on scales used with embodiments of the invention shown for instance in FIGS. 2, 5 and 8 and appropriate graduations could also be utilized in connection with FIG. 3 by marking the graduations on the top of each of the upright elements 30 and 31. For instance, the upright 30 could have graduations for use when the mirror is tilted in a manner shown in the figure while a second set of graduations could be utilized on the upright 31 for use when the mirror is tilted in the opposite direction. With this arrangement, the user can immediately determine the desired position of the mirror by referring to the scale and then setting the mirror to the specific graduation selected. At the same time, the user can immediately see the appearance he or she will present to an observer at a specific elevation above or below the user and at distances of 36 inches, 72 inches or 96 inches. The same scale can be used when tilting the mirror to one side or the other from a vertical position so that a single reference scale is all that is needed. FIG. 10B illustrates a scale similar to that shown in FIG. 10A except that the focal length is 12 inches and each major division of one inch is divided into third's of inches.

FIGS. 11A and 11B illustrate simplified forms of the scales illustrated in FIGS. 10A and 10B. In FIG. 11A, the focal length or distance of the user from the mirror is nine inches and the height of the observer above or below the user's height is indicated only for a distance of only 36 inches. However, the scale is duplicated above and below the zero or eye level plane. FIG. 11B is similar to FIG. 11A except that the focal length is fixed at 12 inches and each inch division is divided into thirds and the corresponding differences in height between the observer and the user are indicated accordingly.

From the foregoing description, it is quite apparent that with appropriate instructions the user can adjust the angle of the mirror through the utilization of the horizontal lines 14 by merely aligning the eyes with a given line and then displacing the mirror until the appropriate line above or below eye level is brought into alignment with eye level. For instance, in the case of the chart 10A, if the user is at a focal length of 9 inches and brings the 6th line above the eye level into alignment with eye level, then the user will view an image corresponding to the appearance presented to an observer at a height six inches greater than the height of the user and at a distance of 36 inches. The same scale would apply in the opposite direction. FIG. 10B would be utilized if the user is at a focal length of 12 inches. In the case of FIGS. 11A and 11B, because of the simplicity of the scales, it may be possible to imprint the scales directly on the apparatus as for instance a structure shown in FIG. 2 wherein the scales could be easily imprinted on the bottom 17. In other cases such as FIGS. 3, 5 and 8, the graduations can carry appropriate reference numerals or letters for coordination with separate charts.

It is also evident from the foregoing that the user may be principally interested in that aspect of the invention wherein the mirror is tilted in order to observe one's appearance as presented to another at a given distance and elevation. In such a case, it would not be necessary to provide the horizontal and vertical lines on the mirror if the mirror is provided with appropriate scales since the user would utilize the scales to fix the angle of the mirror. However, since the horizontal and vertical lines are useful in the application of cosmetics and should the user so desire, the horizontal lines could be utilized to fix the angle of the mirror instead of utilizing scales imprinted on the mirror structure. In the latter case of course, charts such as shown in FIGS. 10A and 10B would be made available to the user so that the desired angle can be readily determined to attain the desired objectives.

While only certain forms of the invention have been illustrated and described, it is understood that alterations, changes and modifications may be made without departing from the true scope and spirit thereof.

What is claimed is:

1. A cosmetic application and observer line of sight mirror comprising a plane mirror, two sets of spaced parallel lines associated with at least part of the surface of said mirror with one set of lines being substantially horizontal and the other set of lines being at right angles thereto said sets of lines facilitating application of make-up by the user, and means including a scale operable by the user for tilting said mirror about a horizontal axis said scale enabling the user to observe the appearance presented to an observer at selected distances and elevations and said scale being calibrated in terms of the elevation and distance of an observer relative to the user and the distance of the user from the mirror.

2. A cosmetic application and observer line of sight mirror according to claim 1 wherein said mirror is hinged along its upper edge to an angularly adjustable support, said support being hinged at its lower edge to said base and means on said base including said scale for adjustably engaging the bottom edge of said mirror to facilitate positioning of said mirror at a desired viewer observation elevation and distance.

3. A cosmetic application and observer line of sight mirror according to claim 2 including means for leveling said base.

4. A cosmetic application and observer line of sight mirror according to claim 1 including a support for said mirror having a base structure including a pair of spaced upright members, and a pivoting structure pivoting said mirror to said upright members for movement about a horizontal axis, said scale means being carried by said supports.

5. A cosmetic application and observer line of sight mirror according to claim 4 wherein said scale means comprises a movable indicator carried by one of said structures and a scale carried by the other of said structures.

6. A cosmetic application and observer line of sight mirror according to claim 4 including means for leveling said base.

7. A cosmetic application and observer line of sight mirror comprising a plane mirror, two sets of spaced parallel lines associated with at least part of the surface of said mirror with one set of lines being substantially horizontal and the other set of lines being at right angles thereto and means for tilting said mirror about a horizontal axis, said set of horizontal lines being uniformly spaced with the spacing between said lines being coordinated with the distance of the user from the mirror to enable the user to tilt said mirror through a predetermined angle from a vertical position by aligning a selected horizontal line with the line of sight of the user with the mirror image to enable the user to view the appearance presented to an observer at a predetermined distance and elevation, a scale carried by said mirror and having graduations coordinated with the said horizontal lines on said mirror and the distance of the user from the mirror, said graduations identifying the distance and elevation of the observer at successive angles of deviation from a vertical plane whereby the user can observe the appearance presented to others at various distances and elevations, both sets of lines functioning to facilitate the application of make-up.

* * * * *